US005117723A

United States Patent [19]

Veenschoten

[11] Patent Number: 5,117,723

[45] Date of Patent: Jun. 2, 1992

[54] CAPO WITH WORM GEAR ADJUSTMENT

[76] Inventor: Frederick V. Veenschoten, 850 N. 10th Ave., Pensacola, Fla. 32501

[21] Appl. No.: 669,659

[22] Filed: Mar. 14, 1991

[51] Int. Cl.[5] ..... G10D 3/00; G10D 3/04

[52] U.S. Cl. ..... 84/318

[58] Field of Search ..... 84/318; 24/513, 514; 269/226; 81/487

[56] References Cited

U.S. PATENT DOCUMENTS

| | | | |
|---|---|---|---|
| 608,278 | 8/1898 | Benson | 84/318 |
| 775,399 | 11/1904 | Halladay | 84/318 |
| 4,854,016 | 8/1989 | Rice | 24/495 |

*Primary Examiner*—L. T. Hix
*Assistant Examiner*—Eddie C. Lee
*Attorney, Agent, or Firm*—Kelly O. Corley

[57] ABSTRACT

A capo for simultaneously adjusting the pitch of a stringed musical instrument. A worm-and-sector gear provides for adjusting the pressure exerted on the strings of the instrument.

2 Claims, 1 Drawing Sheet

CAPO WITH WORM GEAR ADJUSTMENT

The invention relates to the art of capos for use with stringed instruments, and more particularly to capos which are capable of easily adjusting the tension applied to the strings.

Many types of capos are known for simultaneously adjusting the pitch of two or more strings on stringed instruments such as guitars, banjos, etc. Most known capos require two hands for ready installation or adjustment, and may require readjustment due to loosening due to vibration.

According to the present invention, these and other problems of prior art capos are avoided by provision of a novel and improved capo which is readily installed or adjusted with one hand.

According to a principal aspect of the invention, there is provided a capo for attachment to the neck of a stringed musical instrument, the neck having a longitudinal axis, opposite sides, an upper surface, and a lower surface, transverse frets disposed on the upper surface and a plurality of strings disposed parallel to the axis and above the frets, the capo comprising a frame; an elongated top pressure bar means, projecting from the frame and adapted to extend transversely of the longitudinal axis over the upper surface and the strings, for engaging and urging the strings into contact with a selected one of the frets; a worm gear mounted for rotation in the frame; a brace member projecting from the frame and adapted to extend transversely of the longitudinal axis for engagement with the lower surface; one of the elongated top pressure bar and the brace having a proximal end comprising a sector gear engaging the worm gear, a medial region, and a distal region; means for pivotally mounting the medial region on the frame; and means for selectively rotating the worm gear whereby the distal region is urged toward the remaining one of the elongated top pressure bar and the brace, whereby the brace is urged into contact with the lower surface and the strings are urged by the pressure bar into contact with a selected one of the frets.

According to another aspect of the invention, there is provided a capo for attachment to the neck of a stringed musical instrument, the neck having a longitudinal axis, opposite sides, an upper surface, and a lower surface, transverse frets disposed on the upper surface and a plurality of strings disposed parallel to the axis and above the frets, the capo comprising a frame; an elongated top pressure bar means, projecting from the frame and adapted to extend transversely of the longitudinal axis over the upper surface and the strings, for engaging and urging the strings into contact with a selected one of the frets; a worm gear mounted for rotation in the frame; a lever member having a proximal end comprising a sector gear engaging the worm gear, a medial region, and a distal region adapted for engagement with the lower surface; means for pivotally mounting the medial region on the frame; and means for selectively rotating the worm gear whereby the lever member is urged into contact with the lower surface and the strings are urged by the pressure bar into contact with a selected one of the frets.

Other aspects will in part appear hereinafter and will in part be apparent from the following detailed disclosure taken together with the accompanying drawings, wherein.

Figure 1:
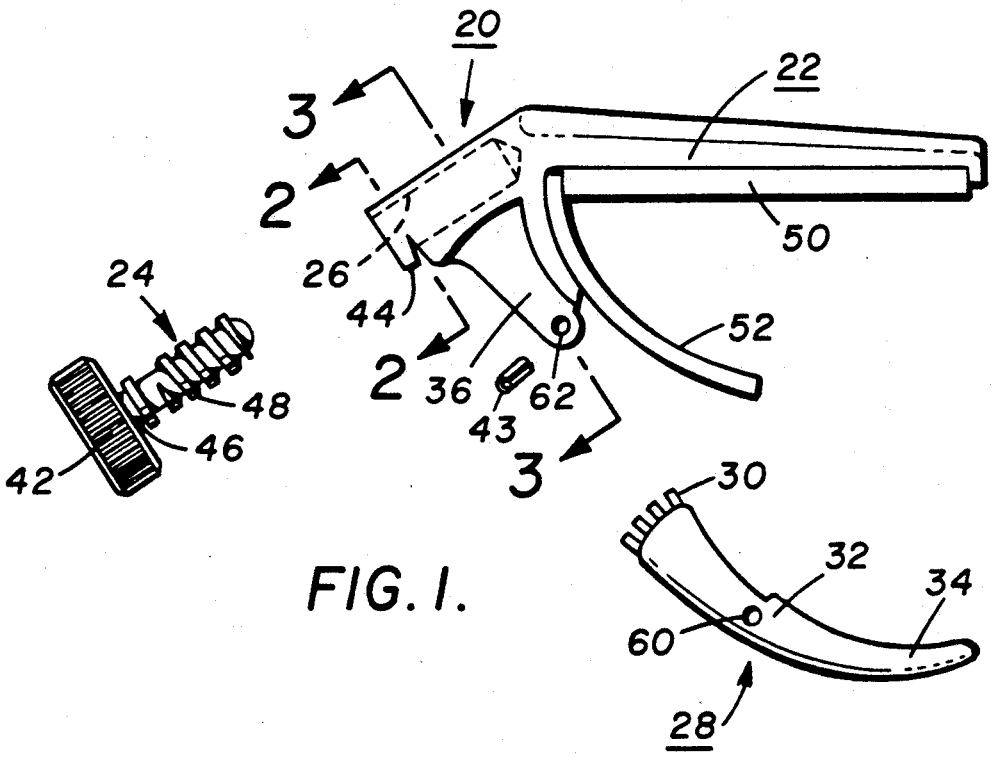
FIG. 1 is an exploded view of the preferred embodiment of a capo according to the present invention.

Referring to FIG. 1, the capo comprises frame 20 having elongated top pressure bar means 22 integrally formed thereon and projecting therefrom. Top pressure bar means 22 is adapted to extend transversely of the longitudinal axis of the neck of a stringed instrument such as a guitar, banjo, or the like, above the upper surface of the neck and above frets mounted transversely to the axis of the neck and on the upper surface of the neck. Pressure bar means 22 is intended and adapted for engaging and urging the strings of the musical instrument into contact with a selected one of the frets on the neck of the instrument, thereby changing the pitch produced when each of the strings is plucked or otherwise excited in order to produce sound.

Worm gear 24 is mounted for rotation in cylindrical recess 26 formed in frame 20. Recess 26 is indicated in dashed lines in FIG. 1. Brace or lever 28 comprises proximal end 30 in the form of a sector gear for engaging worm gear 24, a medial region 32, and a distal region 34. Extension 36 integrally formed on frame 20 provides means for pivotally mounting medial region 32 on frame 20.

Figure 2:
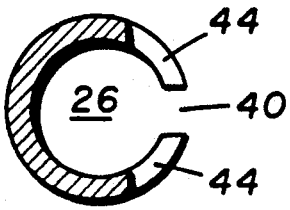
FIG. 2 is a sectional view taken along line 2—2 in FIG. 1.
Figure 3:
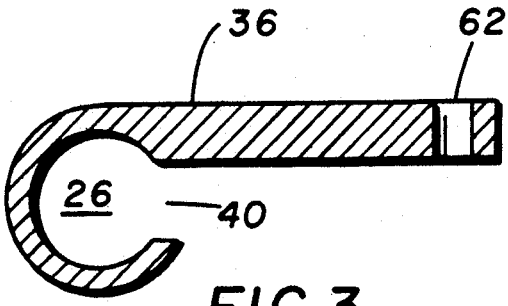
FIG. 3 is a sectional view taken along line 3—3 in FIG. 1.

Vertical slot 40 (FIGS. 2 and 3) is formed in frame 20 alongside extension 36, and communicates with cylindrical recess 26 over most of the length of worm gear 24. When assembled, proximal end 30 with its sector gear are received in slot 40 with sector gear 30 engaging worm gear 24. Pin 43 is installed through aligned apertures 60 and 62 in medial region 32 and extension 36, providing for the noted pivoting action of lever 28.

Figure 4:
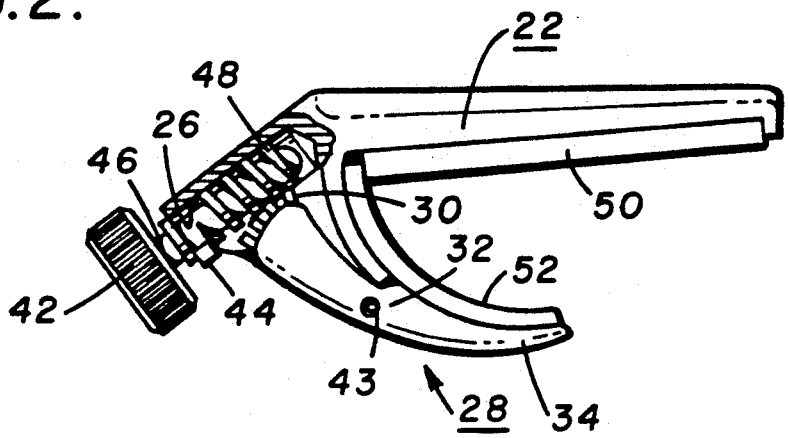
FIG. 4 is a side elevation of the capo, partly broken away.

Worm gear 24 is provided on its lower end with integral knurled knob 42. With the capo assembled, with worm gear 24 further inserted into recess 26 than is illustrated in FIG. 4, tabs 44 on the lower end of frame 20 are bent or peened into annular slot 46 formed between knob 42 and threads 48 on worm gear 24, thus preventing axial movement of worm gear 24. As illustrated, tabs 44 may be formed by forming a slot in frame 20 perpendicular to and intersecting vertical slot 40 and communicating with recess 26.

Optional strips 50 and 52, preferably of a material such as leather or rubber, are provided to cushion and protect the instrument from marring or other damage. As illustrated, strip 50 is preferably glued or otherwise mounted in a groove formed in the lower surface of pressure bar means 22, while strip 52 is preferably similarly mounted on the upper surface of extension 36, and the free end thereof would preferably be glued to the upper surface of brace 28 after the capo is assembled. In operation, worm gear 24 is turned in the direction to increase the distance between pressure bar 22 and distal end 34 of brace 28 sufficiently to allow the capo to be placed on the neck of the instrument with pressure bar 22 in the desired location. By turning knob 42 in the appropriate direction, worm gear 24 by engagement with sector gear 30 rotates brace 28 into contact with the lower surface of the neck of the instrument, thus urging the pressure bar downwardly and urging the strings into contact with a selected one of the frets. This installation and the complementary removal can readily be done with one hand.

Due to use of a worm and sector gear combination, there is no tendency for the capo to loosen during use, contrary to those capo designs wherein the end of a screw bears on an adjustable member, and the present capo permits ready adjustment of the force applied to the strings, in contrast to capo designs wherein a spring within the capo provides the pressure or force.

While the preferred embodiment illustrated and specifically described above has brace 28 pivotally mounted on extension 36, it is within the contemplation of the invention to similarly pivotally mount pressure bar 22 on an extension, providing thereon a sector gear cooperating with worm gear 24, while rigidly mounting brace 28 on frame 20, which would merely amount to a reversal of parts.

I claim:

1. A capo for attachment to a stringed musical instrument having a neck, said neck having a longitudinal axis, opposite sides, an upper surface, and a lower surface, transverse frets disposed on said upper surface and a plurality of strings disposed parallel to said longitudinal axis and above said frets, said capo comprising:

a. a frame;

b. an elongated top pressure bar means, projecting from said frame and adapted to extend transversely of said longitudinal axis over said upper surface and said strings, for engaging and urging said strings into contact with a selected one of said frets;

c. a worm gear mounted for rotation in said frame;

d. a brace member projecting from said frame and adapted to extend transversely of said longitudinal axis for engagement with said lower surface;

e. one of said elongated top pressure bar means and said brace member having a proximal end comprising a sector gear engaging said worm gear, a medial region, and a distal region;

e. means for pivotally mounting said medial region on said frame; and f. means for selectively rotating said worm gear whereby said distal region is urged toward the other one of said elongated top pressure bar means and said brace member whereby said brace member is urged into contact with said lower surface and said strings are urged by said elongated top pressure bar means into contact with a selected one of said frets.

2. A capo for attachment to a stringed musical instrument having a neck, said neck having a longitudinal axis, opposite sides, an upper surface, and a lower surface, transverse frets disposed on said upper surface and a plurality of strings disposed parallel to said longitudinal axis and above said frets, said capo comprising:

a. a frame;

b. an elongated top pressure bar means, projecting from said frame and adapted to extend transversely of said longitudinal axis over said upper surface and said strings, for engaging and urging said strings into contact with a selected one of said frets;

c. a worm gear mounted for rotation in said frame;

d. a lever member having a proximal end comprising a sector gear engaging said worm gear, a medial region, and a distal region adapted for engagement with said lower surface;

e. means for pivotally mounting said medial region on said frame; and f. means for selectively rotating said worm gear whereby said lever member is urged into contact with said lower surface and said strings are urged by said elongated top pressure bar means into contact with a selected one of said frets.

* * * * *